US005905805A

United States Patent [19]

Hansen

[11] Patent Number: 5,905,805

[45] Date of Patent: May 18, 1999

[54] ELECTRODYNAMIC TRANSDUCER

[75] Inventor: Kaj Børge Hansen, Horsens, Denmark

[73] Assignee: Kirk Acoustics A/S, Horsens, Denmark

[21] Appl. No.: 08/687,562

[22] PCT Filed: Feb. 10, 1995

[86] PCT No.: PCT/DK95/00063

§ 371 Date: Aug. 7, 1996

§ 102(e) Date: Aug. 7, 1996

[87] PCT Pub. No.: WO95/22234

PCT Pub. Date: Aug. 17, 1995

[30] Foreign Application Priority Data

Feb. 11, 1994 [DK] Denmark ..... 0179/94

[51] Int. Cl.[6] ..... H04R 25/00

[52] U.S. Cl. ..... 381/398; 381/431

[58] Field of Search ..... 381/171, 176, 381/196, 202, 203, 408, 398, 423, 431, 396, FOR 152, FOR 153, FOR 156, FOR 162, FOR 163; 181/157, 158

[56] References Cited

U.S. PATENT DOCUMENTS

| | | | |
|---|---|---|---|
| 3,283,086 | 11/1966 | Evans | 381/431 |
| 3,919,498 | 11/1975 | Beer | 179/155.5 |
| 4,211,898 | 7/1980 | Atoji et al. | 381/203 |
| 4,228,327 | 10/1980 | Sawafuji | 381/196 |
| 5,021,613 | 6/1991 | Garcia | 381/203 |
| 5,430,805 | 7/1995 | Stevenson et al. | 381/431 |

FOREIGN PATENT DOCUMENTS

| | | | |
|---|---|---|---|
| 2128065 | 10/1972 | France . | |
| 0098611 | 8/1979 | Japan | 381/196 |
| 1-144896 | 6/1989 | Japan . | |

*Primary Examiner*—Huyen Le
*Attorney, Agent, or Firm*—Christie, Parker & Hale, LLP

[57] ABSTRACT

An electrodynamic acoustic transducer has its diaphragm with a coil retained with respect to the magnetic system in discrete points along the periphery of the diaphragm, while the rest of the periphery of the diaphragm is not fixed. The diaphragm has tongues at its periphery which are thicker than the rest of the diaphragm, and which are retained between two ring-shaped engagement faces, which, in the preferred embodiment, are formed by a magnetic system which is arranged symmetrically on both sides of the diaphragm. The diaphragm has a flat coil with spiral wound windings, and the diaphragm with coil and termination is supplied integrally with a web of sheet or a film roll comprising a large number of diaphragms, making the diaphragm useful for mounting in the transducer by tape automated bonding.

12 Claims, 4 Drawing Sheets

ELECTRODYNAMIC TRANSDUCER

BACKGROUND OF THE INVENTION

The invention concerns an electrodynamic transducer, a diaphragm, a web of sheet having such a diaphragm and a magnet system for the transducer.

The concept electrodynamic acoustic transducer in particular comprises microphones which convert sound signals in the air into electrical signals, and sound generators which convert electrical signals into sound signals in the air. Traditionally, such transducers have a ring-shaped, wound coil of copper wire which is present in a ring-shaped air gap having a radially oriented magnetic field. Such coils are wound on automatic winding machines, and then the coils are to be mounted on a diaphragm, e.g., by gluing. After their manufacture on a winding machine, the coils and in particular their thin copper wires are vulnerable, and they must therefore be handled with great care in order not to be damaged and with great accuracy. The coils are to be mounted on the diaphragms with narrow tolerances, and also the diaphragm with the mounted coil is to be placed very precisely in the magnetic circuit.

It is increasingly required that microphones to be used in portable telephones shall have small physical dimensions, and it is simultaneously desired that such a small microphone is to have a sensitivity which is comparable to the sensitivity of a traditional, larger microphone. These requirements clash with each other, one reason being that a small diaphragm is less resilient than a corresponding larger diaphragm, and a small diaphragm therefore moves correspondingly less at the same sound pressure than a large diaphragm, which results in a smaller electrical output signal.

SUMMARY OF THE INVENTION

The object of the invention is to provide an electrodynamic transducer having a high sensitivity, which can therefore be manufactured with smaller physical dimensions and with a satisfactory high sensitivity than was possible in the past.

The present invention provides an electrodynamic acoustic transducer whose coil and magnetic circuits are of a structure that makes it possible to manufacture an electrodynamic transducer with very small dimensions so that its size is comparable to the size of electret microphones, and which, notwithstanding this, has a sensitivity which is comparable to electrodynamic transducers of considerably larger dimensions. Electret microphones of small physical dimensions and with a relatively great sensitivity are known, but electret microphones have a number of drawbacks, including extremely high electrical impedance, which requires incorporation of a transistor for signal amplification or impedance transformation, but such a transistor requires power supply. Further, electret microphones are sensitive to incident electromagnetic radiation, particularly at radio frequencies, and their acoustic sensitivity varies with the humidity of the atmosphere.

U.S. Pat. No. 3,919,498 discloses an electroacoustic transducer with a substantially flat diaphragm and a flat or disc shaped coil on the diaphragm. The diaphragm is retained along its entire periphery between a pair of magnets. This results in a relatively stiff diaphragm, which prevents miniaturisation under conservation of transducer sensitivity.

FR-A-2 128 065 likewise discloses a transducer with a flat diaphragm retained along its entire periphery.

The object of the invention is to provide an electrodynamic acoustic transducer which has all the advantages of electrodynamic transducers, including in particular stability of acoustic sensitivity, and which can simultaneously be manufactured in much smaller dimensions so that it will be a ready and attractive alternative to electret microphones.

This object is achieved with a transducer as stated in claim 1, the diaphragm being retained with respect to the magnetic system in non-contiguous regions, in contrast to known electrodynamic acoustic transducers where the diaphragm is secured to the magnetic system along its entire periphery. Since the diaphragm is secured in non-contiguous regions or in discrete points, the resiliency of the diaphragm is increased considerably, which is a prerequisite with a view to reducing the physical dimensions of the diaphragm and thus of the transducer, while imparting a satisfactory high sensitivity to the transducer An electrodynamic transducer thus constructed is not restricted to the preferred embodiment of the invention, which is described below, since also a traditional electrodynamic transducer with a wound coil glued to the diaphragm can obtain an increased sensitivity A transducer of the invention can be assembled without using glue, the assembly being purely mechanical in that the diaphragm is retained between two ring-shaped engagement faces at its periphery. Such attachment may take place as described below in connection with the preferred embodiment, but also by means of a locking ring in connection with a traditional transducer.

When the diaphragm is retained between two ring-shaped engagement faces in non-contiguous regions or discrete points, this attachment in discrete points may take place in that the diaphragm has radially protruding tongues which are present between the ring-shaped engagement faces, while the rest of the periphery of the diaphragm has a smaller radius so these parts are not present between the ring-shaped engagement faces. In another embodiment the entire peripheral area of the diaphragm is present between the ring-shaped engagement faces, and the diaphragm has a larger thickness in the attachment points than outside these points, thereby ensuring that the ring-shaped engagement faces retain the diaphragm only in the predetermined attachment areas It is expedient here that the attachment points of the diaphragm are made thicker in that the electrical connecting wires of the coil extend across these areas. In connection with a diaphragm which consists of a flat sheet on which the coil is not wound but, e.g., printed, it is expedient that the printed conductor paths constitute the thickenings on the diaphragm, and that the other attachment points include an area of conductor material having the same thickness as the connecting wires, since these areas may expediently be manufactured in the same cycle as the coil itself.

For a transducer of the invention it is particularly expedient to use a diaphragm consisting of a flat sheet which carries a substantially disc-shaped coil in one or more plane layers. Such a coil may be manufactured by known methods for the manufacture of printed electronic circuits, by photographic methods with subsequent etching, or by silk screen printing with electrically conductive paste or in another expedient manner. Such a flat diaphragm with a flat coil lends itself extremely well for manufacture on long webs of sheet which are provided with feed holes for feeding in automatic equipment for assembling transducers, said diaphragms being released one by one from the rest of the web of sheet and mounted in a transducer. The mounting technique for this is known as Tape Automated Bonding.

BRIEF DESCRIPTION OF THE DRAWINGS

The invention will be described more fully below with reference to the drawings, wherein.

DETAILED DESCRIPTION

Figure 1:
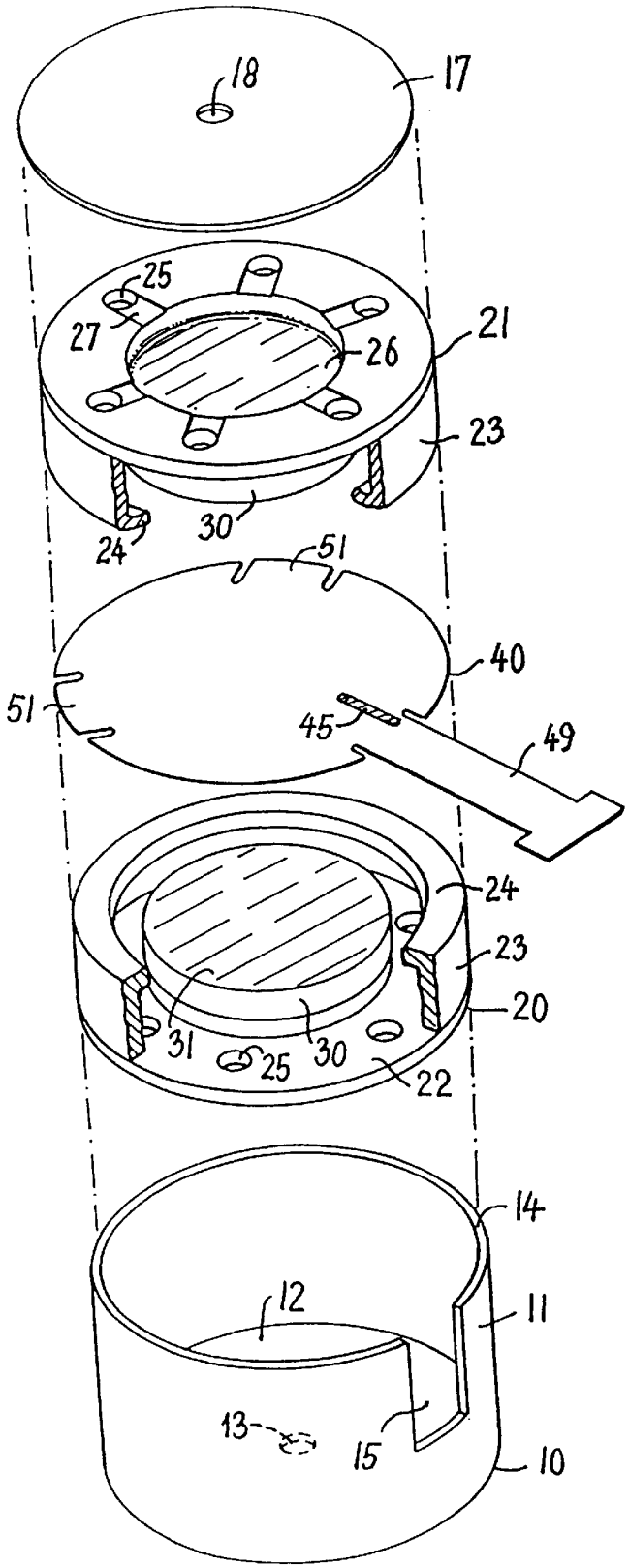
FIG. 1 is an exploded perspective view showing the components of a transducer according to the preferred embodiment of the invention.
Figure 2:
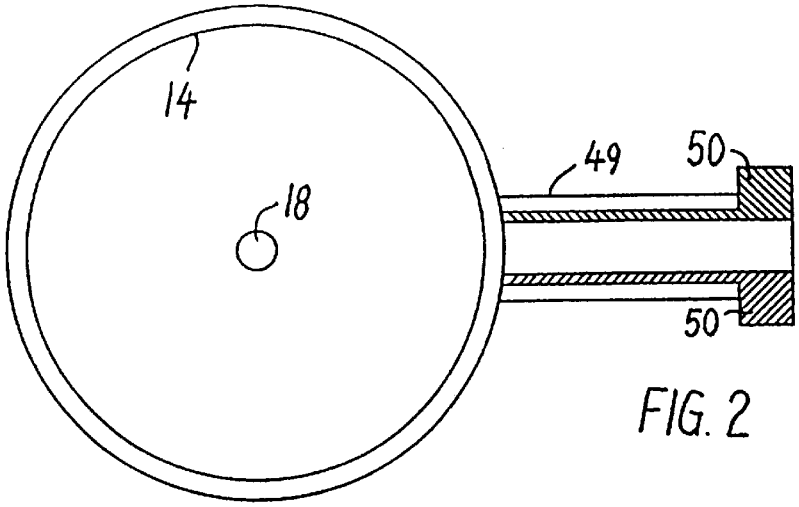
FIG. 2 is a top view of the assembled transducer.

FIG. 1 shows an electrodynamic acoustic transducer according to the invention in exploded perspective view so that its individual components can be seen. The transducer has a housing 10 with a cylindrical wall 11 and a bottom wall 12. The bottom wall 12 is centrally formed with a through hole 13, and the upper, free edge 14 of the cylindrical wall 11 has a rectangular cut 15 which extends to a point slightly below the centre of the cylindrical wall 11.

A magnetic circuit or magnetic system consists of two uniform parts 20, 21 called magnetic half-circuits below. The magnetic half-circuits 20, 21 are shown clearly in FIGS. 1 and 3, and since they are identical, the same reference numerals for these constructional details are used below. The magnetic half-circuits 20, 21 have a circular bottom plate 22 of magnetically conductive material such as, e.g., magnetic soft iron. Along the periphery of the bottom plate 22 there is a cylindrical ring 23, which likewise consists of magnetically conductive material, and which fits closely against the bottom plate 22 along its periphery. The bottom plate 22 and the cylindrical ring 23 are shown here as separate parts, but they may also be made in one piece. The free edge 24 of the cylindrical ring 23 is bent inwards so as to form a collar or flange, and it is noted that the free edge is bent more than 90°, so its scraping edges or burrs, if any, are retracted. The peripheral part of the bottom plate 22 has through holes 25. The outer side of the bottom plate 22 has a central depression 26, and a depression or groove 27 is associated with each of the through holes 25, said depression or groove 27 extending from the respective holes 25 inward to the central depression 26.

The magnetic half-circuits 20, 21 form a cavity, and the inner side of the bottom plate 22 mounts a circular, disc-shaped permanent magnet 30, which is secured to the bottom plate 22, e.g., by gluing or optionally by its own magnetic force of attraction. The magnets 30 are magnetized in their axial direction, i.e., in a direction perpendicular to the bottom plate 22, and in each of the magnetic half-circuits 20, 21 the magnets 30 have the same orientation of their magnetization, i.e., their free magnetic faces 31 have the same magnetic polarity so that both of these faces are, e.g., a north pole, or both are a south pole.

Figure 6B:
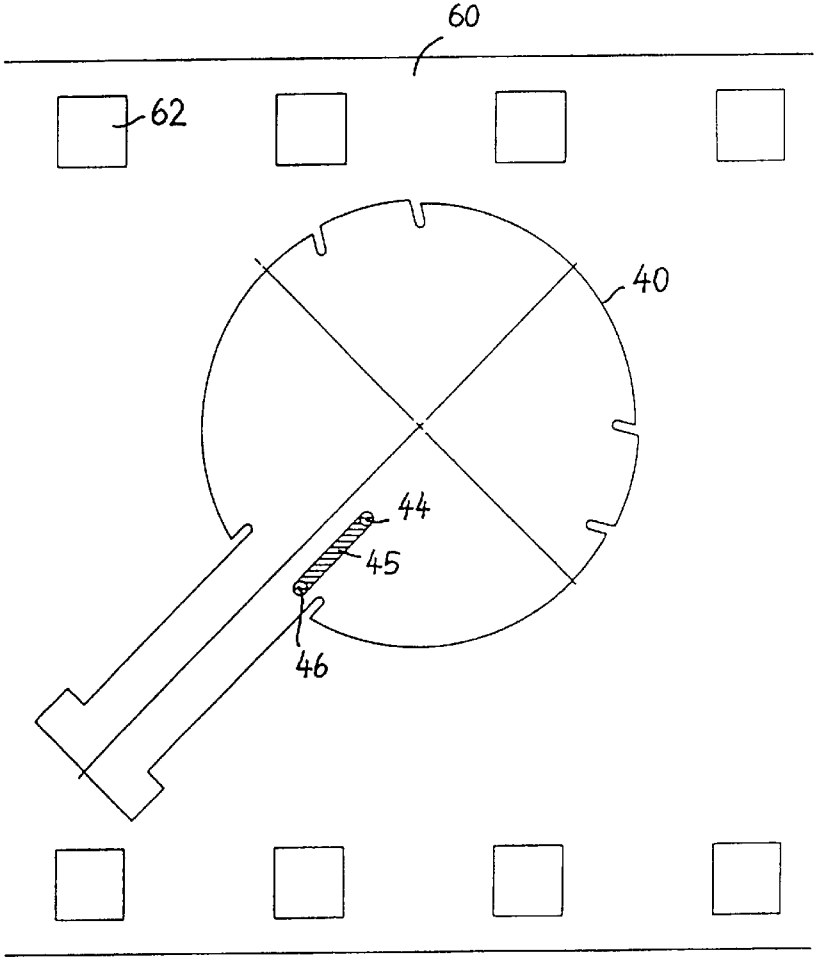
Figure 6A:
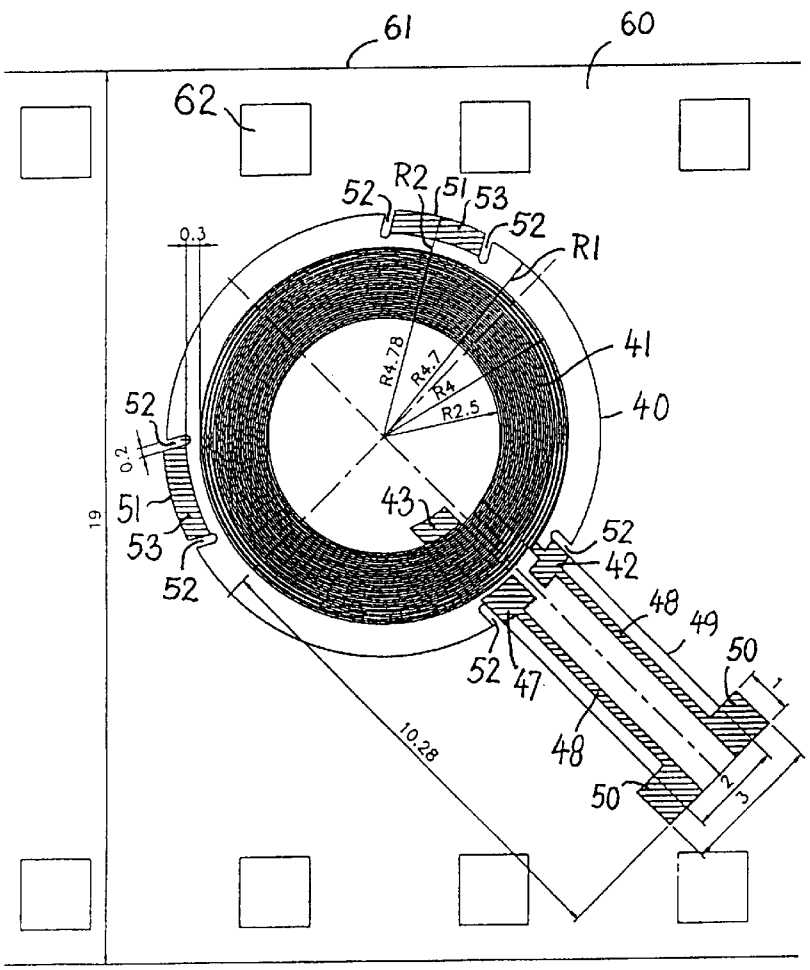

FIG. 1 and FIGS. 6*a* and 6*b* show a diaphragm 40 which consists of a thin, flexible plastic sheet. The diaphragm 40 has the shape of a circular disc, and FIG. 6*a* shows that on one side the diaphragm carries a plurality of windings 41 of electrically conductive material which have been applied to the diaphragm by a process which is useful for that purpose. In practice, the diaphragm 40 has a considerably larger number of windings 41 than is shown in FIG. 6*a,* since this figure is merely a schematic reproduction of the windings 41. The outer end of the windings merges into a wider area 42 at the periphery of the diaphragm, and the inner end of the windings terminate in a corresponding conductor area 43, The diaphragm has a hole 44 below the conductor area 43, and FIG. 6*b* shows how a conductor path 45 from the rear side of the diaphragm establishes a connection in a known manner from the conductor area 43 through the hole 44 and further on to a hole 46 to a conductor area 47 on the front side of the diaphragm. Conductor paths 48, disposed on a tongue 49 of the sheet material, extend from the conductor areas 42 and 47. At the free end of the tongue 49, the conductor paths 48 end in their respective larger conductor areas 50, which serve as electric connecting points for the windings 41 of the diaphragm.

The diaphragm 40 has a radius R1 which is 4.7 mm shown in the example. The diaphragm has two tongues 51 at two points along the periphery, each of said tongues being displaced 120° with respect to the tongue 49. The tongues 51 are defined and bounded by slots or cuts 52 extending from the periphery of the diaphragm, and a slot 52 is provided at each side of the tongues 51. Similarly, slots 52 are provided on both sides of the tongue 49. Instead of two tongues, the diaphragm may have three or more.

The tongues 51 extend to a radius R2 which is larger than R1, and R2 is 4.78 mm in the example. Conductor areas 53 are applied to each of the tongues 51 by the same manufacturing process as for the conductor areas 42 and 47. The conductor areas 42, 47 and 53 on the tongues 49 and 51 constitute a thickening of these tongues. The front side of the diaphragm, which is shown in FIG. 6*a,* may optionally have applied to it a layer of insulating varnish which covers the windings 41 and at least the conductor areas 42 and 47.

FIGS. 6*a* and 6*b* also show that the diaphragm 40 forms part of a web of sheet 60, a large number of diaphragms 40 with associated windings 41 having been produced on the web of sheet 60.

In the production of diaphragms 40 on the web of sheet 60, each individual diaphragm 40 is provided with a plurality of punchings (not shown) with or without removal of sheet material, there being left bridges of sheet material between each diaphragm and the surrounding web of sheet. Along its opposed, longitudinal edges 61, the web of sheet 60 is provided with through holes 62 which are used for precise feeding of the web of sheet 60 in the production of the transducer. When a diaphragm is to be removed from the web of sheet 60 and placed in a transducer, this is done in that the narrow sheet bridges between the diaphragm 40 and the surrounding web of sheet are broken, and the diaphragm 40 is transferred by means of automatic equipment to the transducer, as appears from the following.

FIG. 1 illustrates the order in which the components of the transducer are assembled. First, the magnetic half-circuit 20 is mounted in the housing 10 as shown with the bottom wall downward in engagement with the bottom wall 12 in the housing 10. Then, the diaphragm 40 is mounted, with its long tongue 49 protruding through the rectangular cut 15 in the cylindrical wall 11 of the housing. The diaphragm 40 may be oriented as shown with the windings 41 of the diaphragm on the underside of the diaphragm, or conversely with the windings 41 facing upward. As mentioned, the short tongues 51 have an outer radius R2 which corresponds closely to the internal radius of the cylindrical wall 11 in the housing 10, and when the diaphragm is placed in the housing 10 on the magnetic half-circuit 20, the free ends of the tongues 51 engage the inner side of the cylindrical wall 11 and thus give the diaphragm a well-defined position in a radial direction. The rest of the periphery of the diaphragm, which is located between the tongues, has a radius R1 which is smaller than the radius defined by the free ends of the tongues 51. Thus, the periphery of the diaphragm between the tongues is not in contact with the inner side of the cylindrical wall 11 of the housing.

Then, the magnetic half-circuit 21 is placed on top of the diaphragm. Finally, a cover or lid 17, which is formed with a central through hole 18, is mounted on top of the magnetic half-circuit 21, following which the free edge 14 of the cylindrical wall 11 of the housing is bent over the periphery of the cover 17 to retain said cover.

The hole 18 in the cover 17 and the hole 13 in the bottom wall 12 may be of the same or different shape according to the intended use, and also more holes may be provided, so that the acoustic impedance may be adapted to various conditions.

Figure 3:
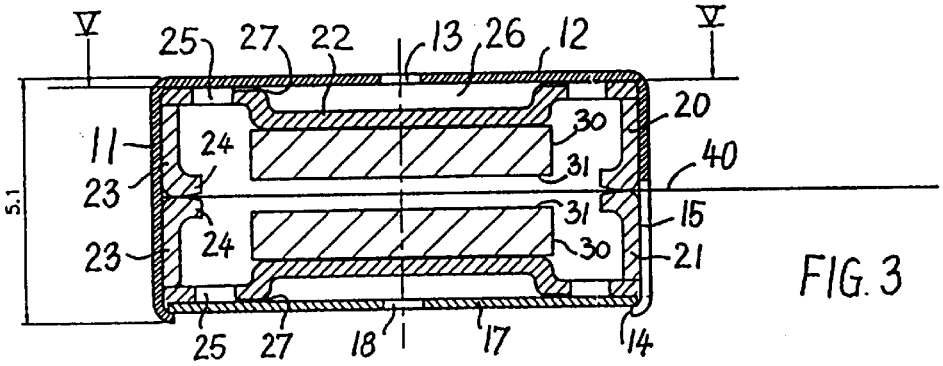
FIG. 3 is an axial section through the transducer of FIG. 2 along the line III—III.
Figure 4:
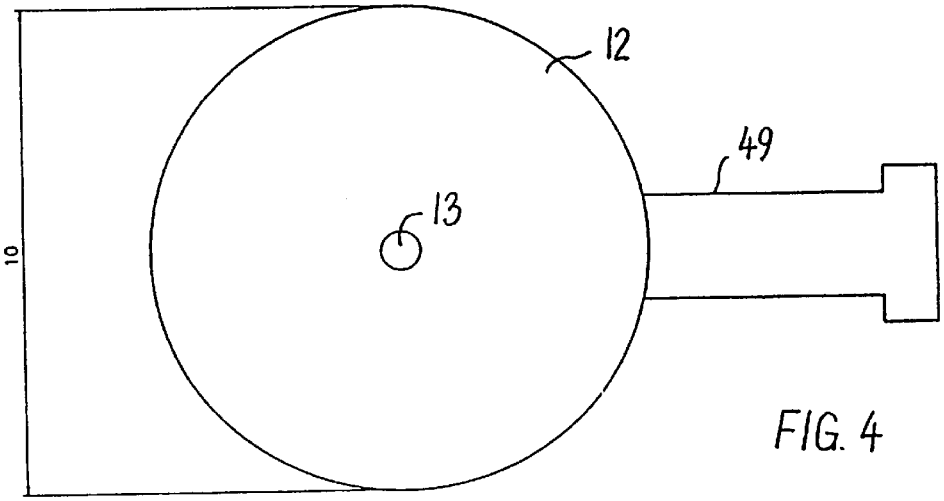
FIG. 4 is a bottom view of the transducer of FIG. 1.
Figure 5:
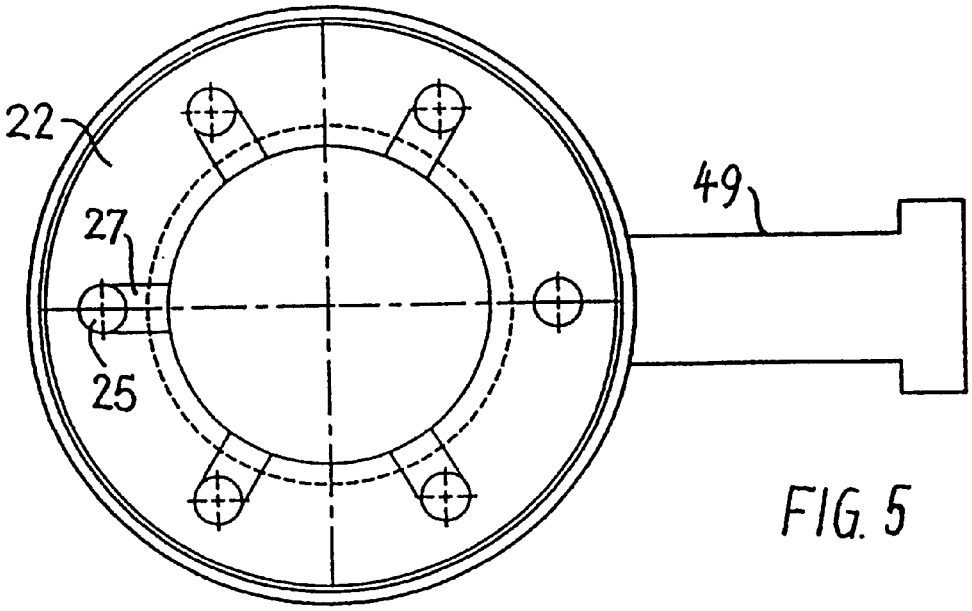
FIG. 5 is a section through the transducer along the line V—V in FIG. 3, FIGS. 6*a* and 6*b* show a web of sheet according to the invention with a diaphragm according to the invention, seen from their respective sides of the web of sheet.

FIG. 3 shows an axial section through the transducer. It will be seen here that the periphery of the diaphragm 40 is positioned between the bent edges 24 of the two cylindrical rings 23. The conductor areas 42, 47 and 53 on the tongues of the diaphragm are present precisely where the bent edges 24 have the smallest distance, and these bent edges 24 thus retain the diaphragm precisely in these areas. Since the conductor areas 42, 47 and 53 constitute a thickening of the diaphragm, the rest of the periphery of the diaphragm, which is also positioned between the bent edges 24, will not be fixed with respect to these edges. In the embodiment shown, the diaphragm typically weighs 3 mg, and with such an extremely low weight it is necessary that the diaphragm has a correspondingly high resiliency, and this resiliency is achieved in that the diaphragm is fixed only in a few points or small areas along its periphery, while the greater part of the periphery of the diaphragm is not fixed.

When the transducer has been assembled, the inner ends of the slots 52 are present within the points where the edges 24 retain the diaphragm Thus, acoustic connection between the two sides of the diaphragm is provided through the slots. This acoustic connection serves partly as a static pressure equalization between the two sides of the diaphragm, but a change in the width and depth of the slots causes the acoustic connection to be changed correspondingly, and in this manner the lower cut-off frequency of the transducer may be adjusted as desired.

Further, the resiliency of the diaphragm may be adjusted by changing the width of the tongues, wide tongues giving a low resiliency, narrow tongues giving a high resiliency.

The acoustic connection from the ambient air to the diaphragm takes place either through the hole 13 or through the hole 18, since these have completely the same function. Through the hole 13 there is acoustic connection to the depression or the cavity 26 in the bottom plate 22 and from there through the six radially extending grooves 27 in the bottom plate, which form narrow channels between the bottom plate 22 and the bottom wall. Further, through the slots 27 there is acoustic connection through the holes 25 to the cavity in the magnetic half-circuit 20 and thereby to the diaphragm 40. Correspondingly, there is acoustic connection through the hole 18 in the cover 17 to the underside of the diaphragm in FIG. 3.

The magnetic circuit and the entire transducer are essentially constructed symmetrically, and it is thus simple to construct the transducer as a microphone in the handset of a telephone apparatus or in a portable telephone, said microphone having two different acoustic input ports spaced differently from the acoustic near field from the speaker's mouth, and the transducer thus serves as a pressure gradient microphone and can thus suppress the ambient noise.

It is noted that the diaphragm is completely surrounded by magnetically conductive material in the form of the bottom plates 22 and cylindrical rings 23 of the magnetic half-circuits. The narrow slot between the bent edges 24 is of the same thickness as the diaphragm and is the only "leakage" of the magnetic field out of the transducer. Because the edges are bent, this slot has a large area which, together with the low thickness of the slot, provides a very low magnetic reluctance in the slot. This results in a very effective screening against external magnetic fields.

In the assembled transducer, the magnets 30 are arranged with like magnetic poles facing each other, and the magnetic field therefore extends substantially radially in the gap between the magnets, and the bent edges 24 causes a concentration of the magnetic field in this area so that the magnetic field extends substantially radially also outside the gap between the magnets.

The oppositely magnetized magnets repel each other, whereby they mutually press each other against the respective bottom plates 22. Gluing of the magnets can hereby be avoided.

A layer of insulating varnish on the diaphragm and its windings and conductor paths results in an increase in the weight of the diaphragm. To exclude the risk that the bent edges 24 when contacting the conductor areas 47 and 42 short-circuit these, a layer of insulating varnish may alternatively be applied to the edges 24.

I claim:

1. An electromagnetic transducer comprising:

a magnetic system having opposed magnetic pole faces which define a gap between the pole faces and provide a magnetic field in the gap between the pole faces; and a diaphragm retained between two ring-shaped engagement faces, said diaphragm carrying a coil with electrically conductive windings which are present in the magnetic field such that when the coil moves in the magnetic field in the gap between the pole faces, an electric voltage is generated in the coil, characterized in that the diaphragm comprises a plurality of retaining areas spaced apart along a periphery of the diaphragm, said diaphragm being retained, with respect to the magnetic system, at each of the retaining areas such that each area along the periphery of the diaphragm between the retaining areas is free to move, said diaphragm having protruding tongues at its periphery which form the retaining areas, said tongues being disposed between the ring-shaped engagement faces.

2. A transducer according to claim 1, characterized in that the diaphragm comprises engagement points disposed on the outer ends of the tongues.

3. A transducer according to claim 1, characterized in that one of the tongues protrudes beyond the ring-shaped engagement faces, and that connecting wires of the coil are disposed on this tongue and form electric terminations for the transducer.

4. An electrodynamic transducer, comprising:

a magnetic system comprising two identical halves, each of the halves having a magnetically conductive cup-shaped part having a bottom wall and substantially closed side walls along the periphery of the bottom wall, and a permanent magnet having a magnetic pole face arranged at the bottom wall and magnetized perpendicularly to the bottom wall, said side walls protruding further from the bottom wall than the magnet and forming a ring-shaped engagement face for the diaphragm, wherein the magnetic pole faces define a gap therebetween and provide a magnetic field in the gap; and a diaphragm retained at its periphery with respect to the magnetic system, said diaphragm carrying a coil with electrically conductive windings which are present in the magnetic field such that when the coil moves in the magnetic field in the gap between the pole faces, an electric voltage is generated in the coil;

characterized in that the diaphragm is retained with respect to the magnetic system in non-contiguous areas.

5. A transducer according to claim 4, characterized in that the side walls have an inwardly extending edge at the ring-shaped engagement face.

6. A transducer according to claim 4, characterized in that its two halves are arranged with their respective engagement faces directed toward each other, and that the bottom walls have through holes.

7. An electrodynamic transducer, comprising:

a magnetic system having opposing magnetic pole faces which define a gap therebetween and provide a magnetic field in said gap; and a diaphragm having a coil with electrically conductive windings disposed in the magnetic field, said coil producing a voltage when moved in the magnetic field, and said diaphragm being retained, with respect to the magnetic system, at non-contiguous areas along a periphery of said diaphragm, each of the non-contiguous areas comprising a protruding tongue defined by a pair of cuts in the periphery of the diaphragm;

wherein said magnetic system comprises a ring-shaped engagement face associated with each of the magnetic pole faces for retaining the diaphragm, each of said protruding tongues being disposed between the ring-shaped engagement faces with a portion of each of the pair of cuts being disposed between the ring-shaped engagement faces.

8. An electrodynamic transducer comprising:

a magnetic system having opposing magnetic pole faces which define a gap therebetween and provide a magnetic field in said gap; and a diaphragm having a coil with electrically conductive windings disposed in the magnetic field, said coil producing a voltage when moved in the magnetic field, wherein said diaphragm comprises a plurality of retaining areas spaced apart along a periphery of the diaphragm, each of said retaining areas comprising a protruding tongue, said periphery of the diaphragm includes areas between the protruding tongues having a first radius, and each of the protruding tongues having a second radius, the second radius being greater than the first radius, said retaining areas comprising a protruding tongue, and wherein said magnetic system comprises a ring-shaped engagement face associated with each of the magnetic pole faces for retaining the diaphragm, each of said protruding tongues being disposed between the ring-shaped engagement faces, said diaphragm being retained, with respect to the magnetic system, at each of the retaining areas such that each area along the periphery of said diaphragm between the retaining areas is free to move.

9. An electrodynamic transducers, comprising:

a magnetic system having opposing magnetic pole faces which define a gap therebetween and provide a magnetic field in said gap, and a magnetic half-circuit associated with each of the magnetic pole faces, each of the magnetic half-circuits comprising a magnetically conductive cup-shaped part having a bottom wall and a substantially closed side wall along a periphery of the bottom wall, and a permanent magnet having the magnetic pole face, said permanent magnet being located on the bottom wall and magnetized perpendicularly to the bottom wall; and a diaphragm having a coil with electrically conductive windings disposed in the magnetic field, said coil producing a voltage when moved in the magnetic field, and said diaphragm being retained, with respect to the magnetic system, at non-contiguous areas along a periphery of said diaphragm;

wherein each of said side walls of the magnetic half-circuits extend further from the bottom wall then the permanent magnet of its respective magnetic half-circuit and forms a ring-shaped engagement face for retaining the diaphragm.

10. The transducer of claim 9, wherein the side wall of each of the magnetically conductive parts has an inwardly extending edge forming the ring-shaped engagement face.

11. The transducer of claim 9 wherein the bottom wall of each of the magnetically conductive parts has a through hole.

12. An electrodynamic transducer, comprising:

a magnetic system having opposed magnetic pole faces which define a gap between the pole faces and provide a magnetic field in the gap between the pole faces; and a diaphragm retained at its periphery with respect to the magnetic system, said diaphragm carrying a coil with electrically conductive windings which are present in the magnetic field such that when the coil moves in the magnetic field in the gap between the pole faces, an electric voltage is generated in the coil, characterized in that substantially the entire periphery of the diaphragm is present between two-ring shaped engagement faces of the magnetic system, and said diaphragm is retained between said two ring-shaped engagement faces in non-contiguous areas, said non-contiguous areas comprising protruding tongues defined by cuts in the periphery of the diaphragm, said cuts extending within the two ring-shaped engagement faces to establish communication between the two sides of the diaphragm, said protruding tongues being thicker than areas between said protruding tongues.

* * * * *

UNITED STATES PATENT AND TRADEMARK OFFICE

CERTIFICATE OF CORRECTION

PATENT NO. : 5,905,805
DATED : May 18, 1999
INVENTOR(S) : Kaj Børge Hansen

It is certified that error appears in the above-identified patent and that said Letters Patent is hereby corrected as shown below:

Column 2,
Line 17, after "transducer" insert a period.
Line 22, after "sensitivity" insert a period.
Line 43, after "areas" insert a period.

Column 4,
Line 6, replace "43, The" with -- 43. The --.

Column 5,
Line 40, after "diaphragm" insert a period.

Column 7,
Line 58-59, after "first radius," delete "said retaining areas comprising a protruding tongue,".

Column 8,
Line 8, change " transducers" to -- transducer --.
Line 27, replace "wall then" with -- wall than --.

Signed and Sealed this

Twenty-first Day of August, 2001

*Attest:*

Nicholas P. Godici

*Attesting Officer*

NICHOLAS P. GODICI
*Acting Director of the United States Patent and Trademark Office*